US012798868B2

(12) United States Patent
Hovey

(10) Patent No.: US 12,798,868 B2
(45) Date of Patent: Nov. 17, 2026

(54) IN SITU GENERATED PROPELLANT PRESSURIZED MATERIAL DISPENSER

(71) Applicant: Illinois Tool Works Inc., Glenview, IL (US)

(72) Inventor: Brentley Cheridan Hovey, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 127 days.

(21) Appl. No.: 18/729,716

(22) PCT Filed: Jan. 18, 2023

(86) PCT No.: PCT/US2023/010992
§ 371 (c)(1),
(2) Date: Jul. 17, 2024

(87) PCT Pub. No.: WO2023/141121
PCT Pub. Date: Jul. 27, 2023

(65) Prior Publication Data

US 2025/0091796 A1 Mar. 20, 2025

Related U.S. Application Data

(60) Provisional application No. 63/300,565, filed on Jan. 18, 2022.

(51) Int. Cl.
*B65D 83/62* (2006.01)

(52) U.S. Cl.
CPC ..... *B65D 83/625* (2013.01)

(58) Field of Classification Search
CPC .... B65D 83/625; B65D 83/141; B65D 83/14; B65D 83/16; B65D 83/20; B65D 83/207;
(Continued)

(56) References Cited

U.S. PATENT DOCUMENTS 2,494,456 A * 1/1950 Still ..... B65D 81/3216 604/416
2,854,977 A * 10/1958 McConnaughey ... A61M 5/284 604/416

(Continued)

FOREIGN PATENT DOCUMENTS

EP 0711243 B1 12/1999
EP 1866216 B1 5/2014

OTHER PUBLICATIONS

Int'l Search Report and Written Opinion Appln No. PCT/US2023/010992 mailed Feb. 5, 2023.

*Primary Examiner* — Donnell A Long
(74) *Attorney, Agent, or Firm* — McAndrews, Held & Malloy, Ltd.

(57) ABSTRACT

A dispenser for dispensing material under pressure that includes a canister defining a chamber and having an opening therein extending from the chamber to an exterior of the canister. A first portion of the chamber adjacent the opening is configured to contain a material for dispensing through the opening. A second portion of the chamber is configured to contain a solution. An enclosed reservoir is provided in the second portion of the chamber, the enclosed reservoir configured to initially contain a catalyst and to be subsequently opened to release at least a portion of the catalyst.

17 Claims, 6 Drawing Sheets

(58) Field of Classification Search
CPC ..... B65D 83/44; B65D 83/75; B65D 83/687; B65D 81/32; B65D 81/3222; B65D 83/40; B65D 83/425; B65D 83/64; B65D 83/42; A61M 15/009; Y10S 215/08; B65B 29/10; B65B 31/003
See application file for complete search history.

(56) References Cited

U.S. PATENT DOCUMENTS 3,240,391 A * 3/1966 Garton ..... B65D 83/687 222/394
3,458,076 A * 7/1969 Babcock ..... B65D 47/06 222/129
3,635,261 A * 1/1972 Morane ..... B65B 29/10 141/3
3,718,236 A 2/1973 Reyner et al.
3,992,003 A 11/1976 Visceglia et al.
4,376,500 A * 3/1983 Banks ..... B65D 81/3233 239/323
4,651,899 A * 3/1987 Pauls ..... B65D 81/32 222/402.1
4,769,395 A * 9/1988 Pauls ..... B65D 83/687 521/137
5,040,704 A * 8/1991 Moran ..... B65D 83/625 222/394
5,154,320 A * 10/1992 Bolduc ..... B65D 83/687 222/394
5,397,303 A 3/1995 Sancoff et al.
5,571,261 A 11/1996 Sancoff et al.
5,605,259 A * 2/1997 Clawson ..... B65D 83/285 222/402.1
7,204,392 B2 * 4/2007 Kwasny ..... B65D 83/687 222/394
2015/0296765 A1 10/2015 Miyaji et al.

* cited by examiner

IN SITU GENERATED PROPELLANT PRESSURIZED MATERIAL DISPENSER

CROSS-REFERENCE TO RELATED APPLICATIONS

The present application is a national stage application under 35 U.S.C. § 371 of International Patent Application No. PCT/US2023/010992, filed on Jan. 18, 2023, and entitled "IN SITU GENERATED PROPELLANT PRESSURIZED MATERIAL DISPENSER," claims priority to U.S. Provisional Application No. 63/300,565, filed Jan. 18, 2022, and are incorporated herein by reference.

FIELD OF THE INVENTION

The present invention relates to a materials dispenser and, more particularly, to devices for dispensing liquids, pastes, foams, and the like, under pressure with an in situ generated propellant.

BACKGROUND OF THE INVENTION

Aerosol dispensers are known throughout modern society and are found in food stores, pharmacies, tool shops, and more to dispense personal, food, cooking, household, industrial, and medical products. Aerosol dispensers provide easy to use methods of dispending products that are best used as an airborne mist or as a thin coating on a surface.

Typical aerosol dispensers include a container, which holds a liquid product to be dispensed, such as soap, insecticide, paint, deodorant, disinfectant, air freshener, or the like, and a propellant that is used to discharge the liquid product from the container. The propellant is pressurized and provides a force to expel the liquid product from the container when a user actuates the aerosol dispenser by pressing an actuator button or trigger. As the aerosol valve is opened, pressure from the propellant gas forces product out of the aerosol container, and at the same time, liquid propellant enters the gas phase to maintain a near constant level of pressurization throughout the lifetime of the aerosol product. Aerosol dispensers typically deliver material pressurized to seven or eight bars.

Typical aerosol dispensers utilize different ways of storing and delivering the liquid product and propellant. Single Compartment containers provide a container with a single compartment in which a deliverable material is mixed with a propellant (a compressed gas), with both being sprayed through a valve for dispensing. Dual Compartment containers provide two compartments within the container that separate the deliverable material from the propellant to avoid interaction between them, to increase shelf life of the product, and for various other reasons. Some Dual Compartment containers use a bag for the deliverable material. Some separate the material from the propellant using a piston barrier. In both cases a compartment with a pressurized propellant is used to pressurize a compartment with a deliverable material, which can then be delivered under pressure through a valve.

Propellants used in aerosol dispensers typically include liquified gas propellants, such as hydrocarbon and hydrofluorocarbon (HFC) propellants, including HFC-1234ze; compressed gas propellants, such as compressed carbon dioxide or nitrogen; or chlorofluorocarbon (CFC) propellants. In typical aerosol dispensers, such propellants coexists as a gas and liquid in equilibrium under pressure in an aerosol container. As the aerosol valve is opened, pressure from the propellant gas forces product out of the aerosol container, and at the same time, liquid propellant enters the gas phase to maintain a near constant level of pressurization throughout the lifetime of the aerosol product. Unfortunately, such propellants commonly used in aerosol dispensers are expensive and often carry an environmental burden given that they are often greenhouse gasses.

Further disadvantages are associated with using propellants in aerosol dispensers including additional laws and regulations in some jurisdictions and added manufacturing and transport expenses. Containers are also often required to be metal, thick glass, or rigid plastic, or in any case to be of sufficient strength and thickness to safely withstand 7 to 8 bars of pressure. If made of metal other than aluminum (which is relatively expensive), containers are usually made out of steel that is often zinc-plated and coated with lacquers or other coatings to prevent them from rusting and releasing the pressure in unintended ways. As a result, aerosol containers are often relatively expensive to make, to transport, and to handle in bulk, are constrained to be in a standard shape, and are difficult to dispose of in an ecologically desirable manner.

Thus, there exists a need for a material dispenser that generates a propellant in situ for dispensing liquids, pastes, foams, and the like.

SUMMARY OF THE INVENTION

A dispenser for dispensing material under pressure that includes a canister defining a chamber and having an opening therein extending from the chamber to an exterior of the canister.

A first portion of the chamber adjacent the opening is configured to contain a material for dispensing through the opening. A second portion of the chamber is configured to contain a solution. An enclosed reservoir is provided in the second portion of the chamber, the enclosed reservoir configured to initially contain a catalyst and to be subsequently opened to release at least a portion of the catalyst.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

Figure 1A:
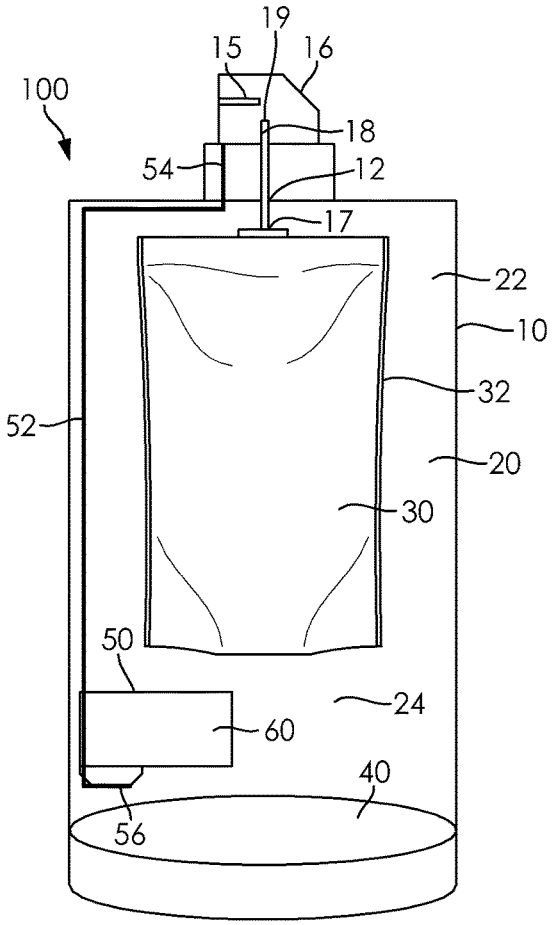
FIG. 1A is a schematic cross-sectional view of a dispenser according to an inventive embodiment of the present disclosure prior to dispensing a material.

The present invention has utility as material dispenser for dispensing liquids, pastes, aerosols, foams, and the like, under pressure without the use of a propellant. The present invention additionally has utility as a dispenser that is easy and inexpensive to manufacture and transport, is not constrained to a single shape or limited materials, that does not include ingredients that are harmful to the environment, and that is easily disposed of in an environmentally friendly manner.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention.

Unless indicated otherwise, explicitly or by context, the following terms are used herein as set forth below.

As used in the description of the invention and the appended claims, the singular forms "a," "an" and "the" are intended to include the plural forms as well, unless the context clearly indicates otherwise.

Also as used herein, "and/or" refers to and encompasses any and all possible combinations of one or more of the associated listed items, as well as the lack of combinations when interpreted in the alternative ("or").

According to a particular inventive embodiment, an inventive dispenser 100 for dispensing material 30 under pressure includes a canister 10 that defines a chamber 20 and has an opening 12 therein. The opening 12 extending from the chamber 20 inside the canister 20 to an exterior of the canister 10. The canister 10 includes a first portion 22 of the chamber 20 and a second portion 24 of the chamber 20. The first portion 22 of the chamber 20 is positioned adjacent to the opening 12. The first portion 22 of the chamber 20 is configured to contain the material 30 that is to be dispensed from the dispenser 100 through the opening 12 in the canister 10. The second portion 24 of the chamber 20 is configured to contain a solution 40. The inventive dispenser 100 additionally includes an enclosed reservoir 50 provided in the second portion 24 of the chamber 20. The enclosed reservoir 50 is configured to initially contain a catalyst 60 and to be subsequently opened to release at least a portion of the catalyst 60. According to some inventive embodiments, when the catalyst 60 is released from the enclosed reservoir 50 and mixes with the solution 40 in the second portion 24 of the chamber 20, a gas is formed that increases the pressure within the canister 10, thereby pushing the material 30 to be dispensed out of the first portion 22 of the chamber 20 through the opening 12 in the canister 10. Accordingly, the inventive dispenser 100 is configured to dispense the material 30 from the canister 10 under pressure without the use of a propellant.

According to some inventive embodiments, the canister 10 is formed of metal, such as aluminum, or zinc-plated; plastic, such as high density polyethylene (HDPE); or glass. The interior of the canister 10 must be storage stable relative to any contents therein that are stored in contact with the interior of the canister 10. Accordingly, the interior of the canister 10 is provided with a protective coating thereon, according to some inventive embodiments.

According to some inventive embodiments, the dispenser 100 is outfitted with various outlets positioned around the opening 12 at the exterior of the canister 10. According to some inventive embodiments, the various outlets are interchangeable by a user based on the dispensing application. According to some inventive embodiments, an actuator 16 is positioned around the opening 12 at the exterior of the canister 10. According to some inventive embodiments, a nozzle 14 is positioned around the opening 12 at the exterior of the canister 10 through which the material 30 is configured to be dispensed. According to some inventive embodiments, a tube 18 is positioned within the opening 12 through which the material 30 is configured to be dispensed. The tube 18 includes a first end 17 that extends into the first portion 22 of the chamber 20 and a second end 19 that extends out of the canister 10. According to some inventive embodiments, the second end 19 of the tube 18 is configured to be connected to a hose 70 or a nozzle 14, or another dispenser extender. According to some inventive embodiments, the second end 19 of the tube 18 is threaded for attachment of the hose 70, nozzle 14, or another dispenser extender. According to some inventive embodiments, the second end 19 of the tube 18 is configured to fluidly communicate with an opening 15 in an actuator 16 when the actuator 16 is depressed, as shown in FIGS. 1B and 2B.

Figure 7A:
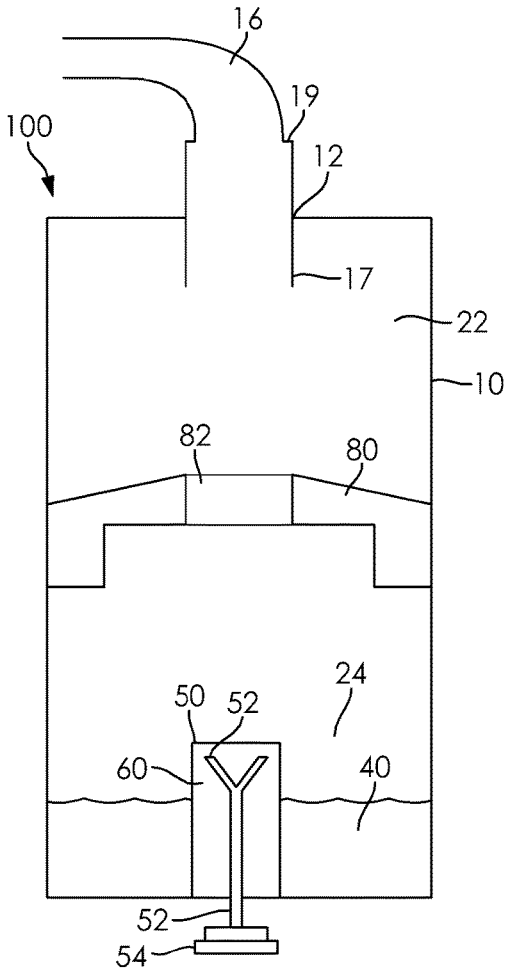
FIG. 7A is a schematic cross-sectional view of a dispenser according to an inventive embodiment of the present disclosure prior to dispensing a material.
Figure 7B:
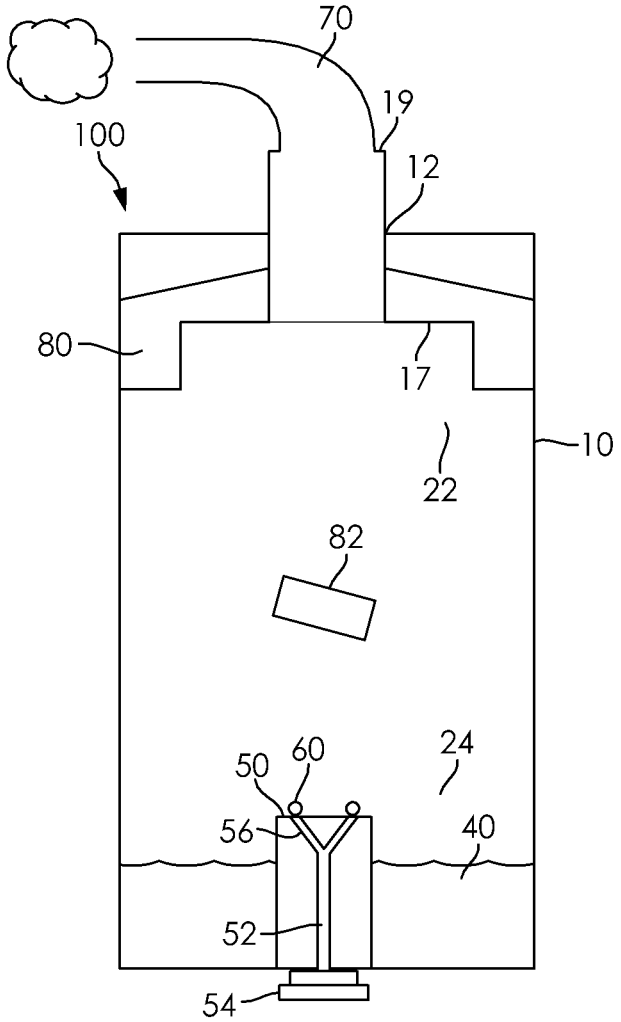
FIG. 7B is a schematic cross-sectional view of the dispenser of FIG. 7A after dispensing the material.

According to some inventive embodiments, the material 30 is kept separate from the solution 40 by various structures that may be used alone or in combination. According to some inventive embodiments, the material 30 contained in the first portion 22 of the chamber 20 is separated from the solution 40 contained in the second portion 24 of the chamber 20 by a piston 80, as shown in FIG. 7A. Accordingly, the first portion 22 of the chamber 20 and the second portion 24 of the chamber 20 are separated by the piston 80 disposed within the canister 10. According to some inventive embodiments, the piston 80 is configured to move within the chamber 20 of the canister 10. It will be understood that as the piston 80 moves towards the opening 12 in the canister 10, the piston 80 pushes the material 30 contained in the first portion 22 of the chamber 20 out of the opening 12 in the canister 10. According to some inventive embodiments, the piston 80 is moved toward the opening 12 by force generated by building pressure within the second portion 24 of the chamber 20 when the solution 40 mixes with the catalyst 60. According to some inventive embodiments, the piston 80 includes a punch-out disk 82 that is in axial alignment with the opening 12 in the canister 10. According to some inventive embodiments, as shown in FIG. 7B, when the piston 80 reaches the end of the canister 20 near the opening 12 and has thus pushed the material 30 of the first portion 22 of the chamber 20 out of the opening 12, the piston 80 makes contact with the second end 19 of the tube 18, which punches out the punch-out disk 82, thereby allowing the second portion 24 of the chamber 20 to fluidly communicate with the opening 12 of the canister 10. Accordingly, the contents of the second portion 24 of the chamber 20, which at this point is pressurized gas, is released from the canister 10 through the tube 18 to the exterior of the canister 10. According to such some inventive embodiments, the material 30 that is released may advantageously by a flat tire sealant, while the pressurized gas may then serve to inflate the tire.

According to some inventive embodiments, the material for dispending 30 is kept separate from the solution 40 within the canister 10 by providing a flexible bag 32 in the first portion 22 of the chamber 20. In such embodiments, the flexible bag 32 is in fluid communication with the opening 12 of the canister 10. A flexible bag 32 may be used with or without a piston 80. According to some inventive embodiments, the flexible bag 32 is formed of a variety of materials that illustratively include low-density polyethylene (LDPE). According to some inventive embodiments, when the solution 40 in the second portion 24 of the chamber 20 mixes with the catalyst 60, the reaction therebetween results in gas, which increases the pressure within the canister 10. The increased pressure within the chamber 20 forces the material to be dispensed 30 through the opening 12 and out of the canister 10. According to some inventive embodiments, the pressure may act upon the flexible bag 32 directly or may act on a piston 80, as described above, which in turn acts on the flexible bag 32.

Figure 4:
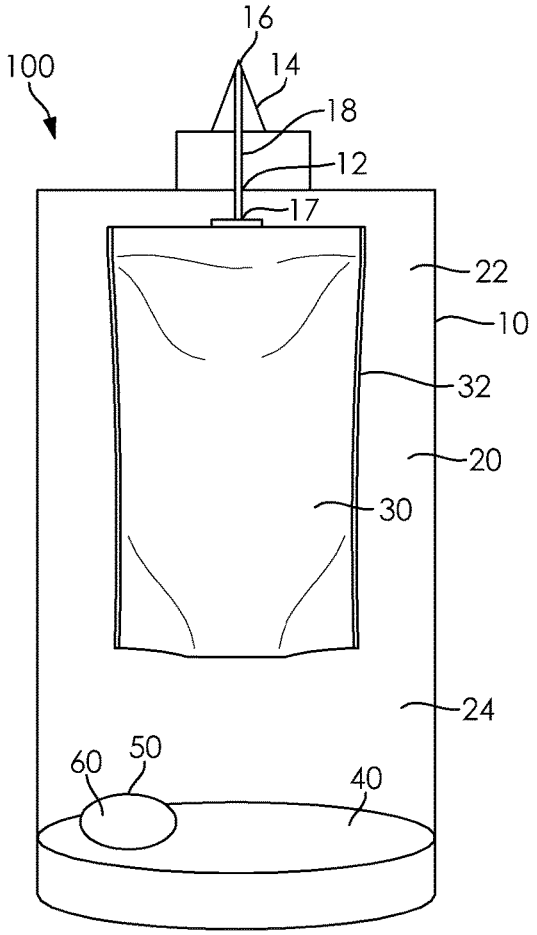
FIG. 4 is a schematic cross-sectional view of a dispenser according to an inventive embodiment of the present disclosure prior to dispensing a material.
Figure 5:
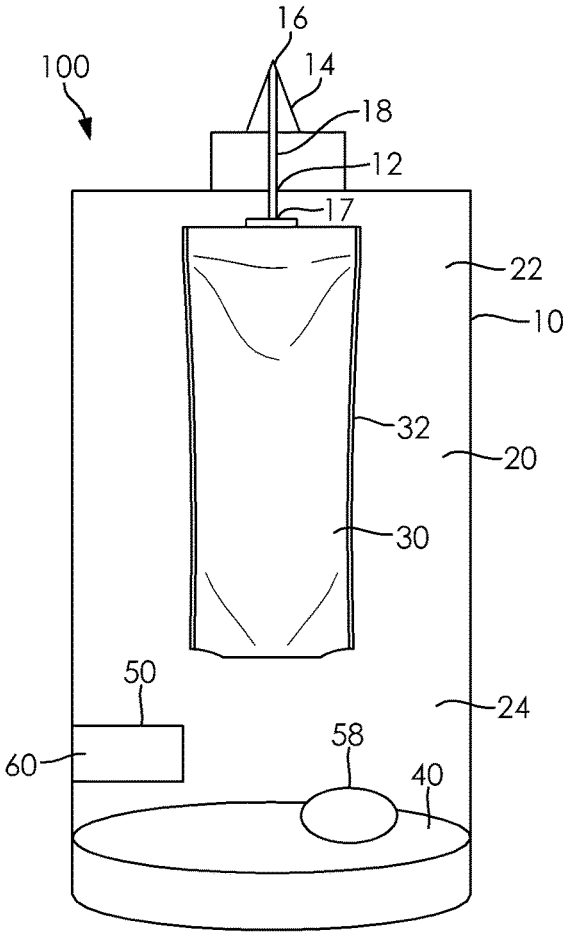
FIG. 5 is a schematic cross-sectional view of a dispenser according to an inventive embodiment of the present disclosure prior to dispensing a material.
Figure 6:
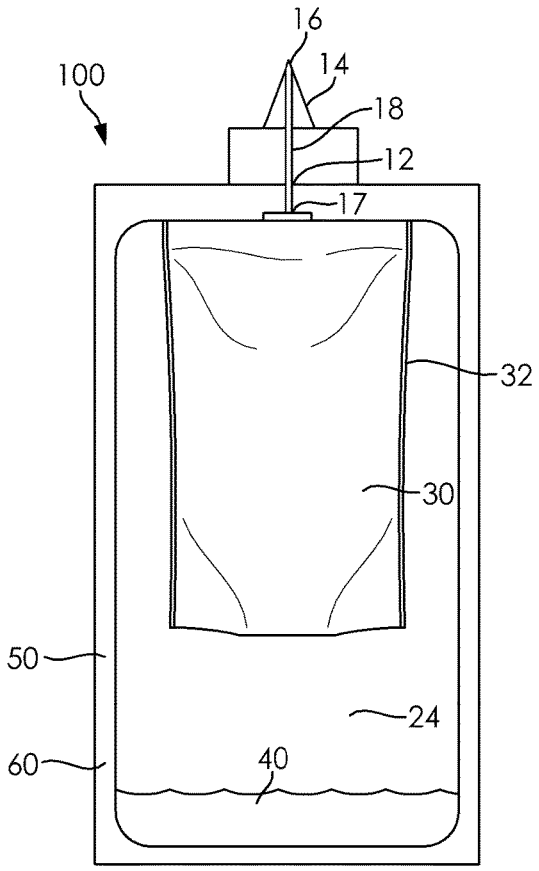
FIG. 6 is a schematic cross-sectional view of a dispenser according to an inventive embodiment of the present disclosure prior to dispensing a material.

As noted above, the inventive dispenser 100 includes an enclosed reservoir 50 positioned within the chamber 20 of the canister 10. The enclosed reservoir 50 is configured to initially contain a catalyst 60 and to be subsequently opened to release at least a portion of the catalyst 60. According to some inventive embodiments, the enclosed reservoir 50 is formed of High Density Polyethylene (HDPE) or glass. According to some inventive embodiments, the enclosed reservoir 50 is opened in a variety of ways, including by creating an opening in the reservoir 50, for example by puncturing, rupturing, or breaking the material that defines the reservoir 50, or by uncovering an existing opening provided in the material that defines the reservoir 50. According to some inventive embodiments, the enclosed reservoir 50 is provided as a capsule, as shown in FIGS. 4, which may move freely within the solution 40. According to such some inventive embodiments, the enclosed reservoir 50 is configured to be broken upon shaking the canister 10, which causes the capsule to come into contact with a wall of the canister 10 with sufficient force to break the capsule 50. According to some inventive embodiments, in which the enclosed reservoir 50 is an enclosure attached to a wall of the canister 10, as shown in FIG. 5, the enclosure may be broken upon shaking the canister by causing an object 58 positioned within the canister 10 to come into contact with the enclosure 50 with sufficient force to break the enclosure 50. According to some inventive embodiments, the enclosed reservoir 50 configured to initially contain a catalyst 60 is provided as a sleeve 50 within the canister 10, as shown in FIG. 6. The sleeve 50 is positioned along the interior wall of the canister 10. According to such embodiments, the enclosed reservoir 50 is configured to be broken upon squeezing and/or bending the canister 10, thereby allowing the catalyst 60 out of the reservoir 50 to mix with the solution 40.

Figure 1B:
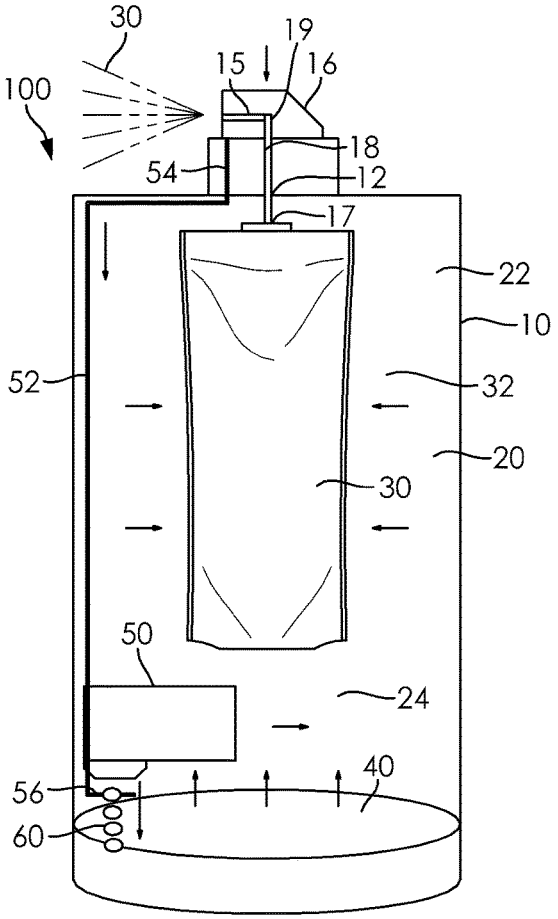
FIG. 1B is a schematic cross-sectional view of the dispenser of FIG. 1A after dispensing the material.
Figure 2A:
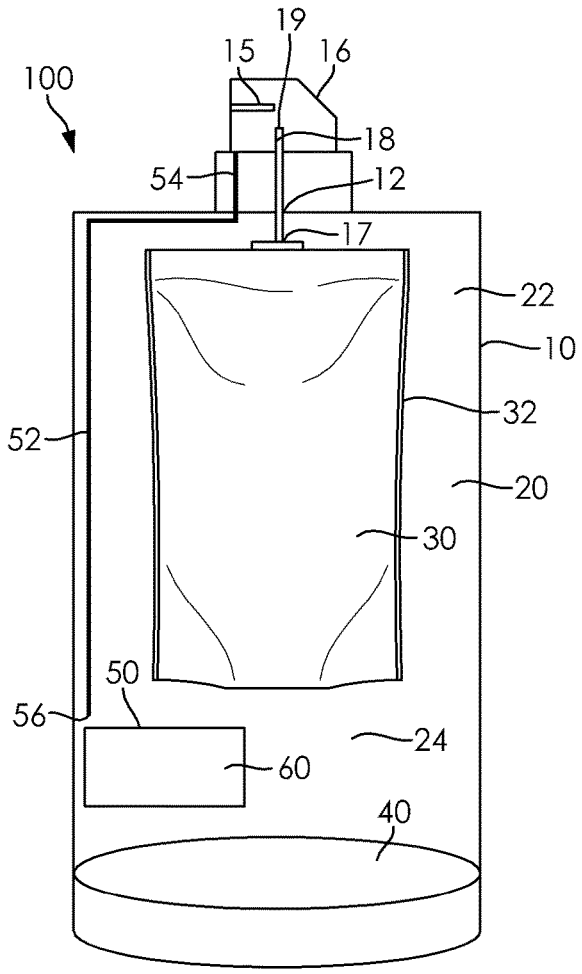
FIG. 2A is a schematic cross-sectional view of a dispenser according to an inventive embodiment of the present disclosure prior to dispensing a material.
Figure 2B:
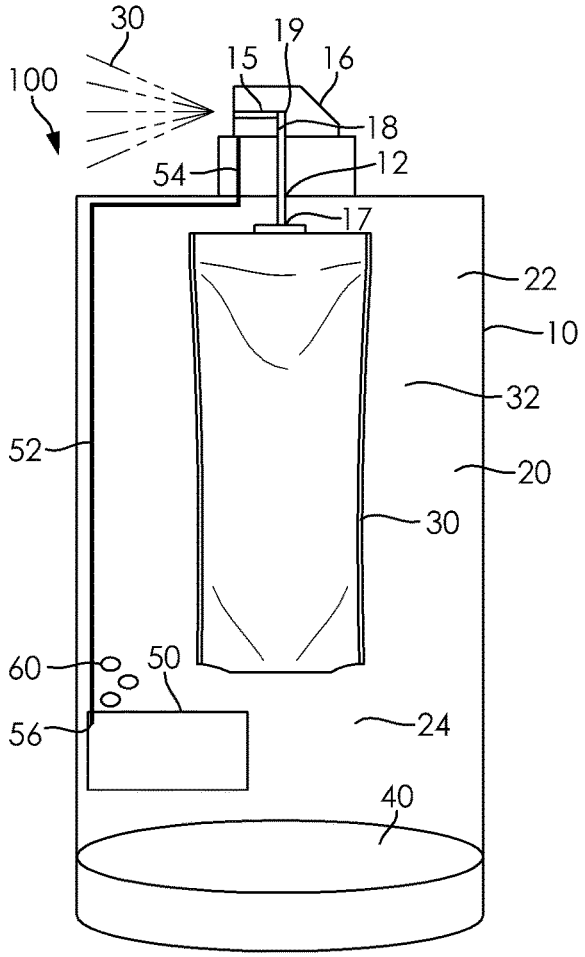
FIG. 2B is a schematic cross-sectional view of the dispenser of FIG. 2A after dispensing the material.
Figure 3A:
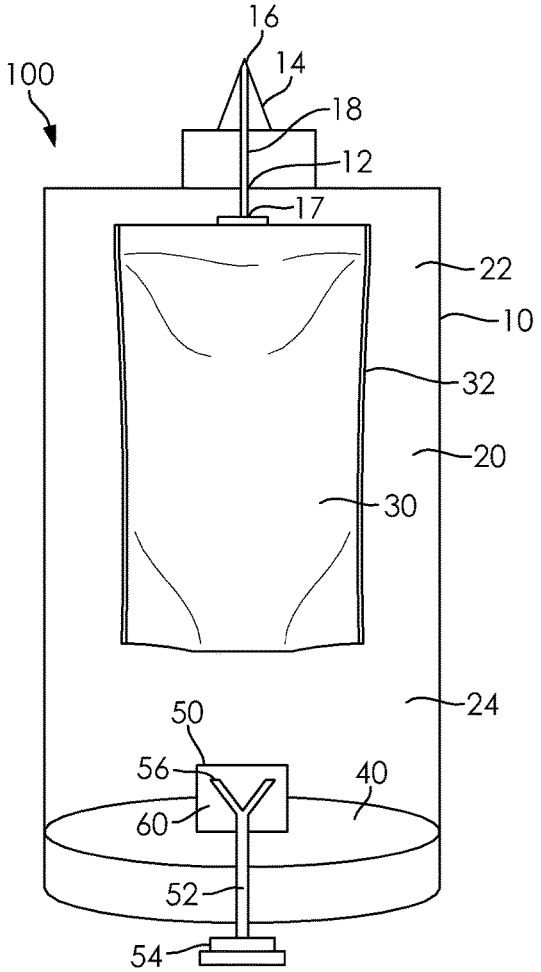
FIG. 3A is a schematic cross-sectional view of a dispenser according to an inventive embodiment of the present disclosure prior to dispensing a material.
Figure 3B:
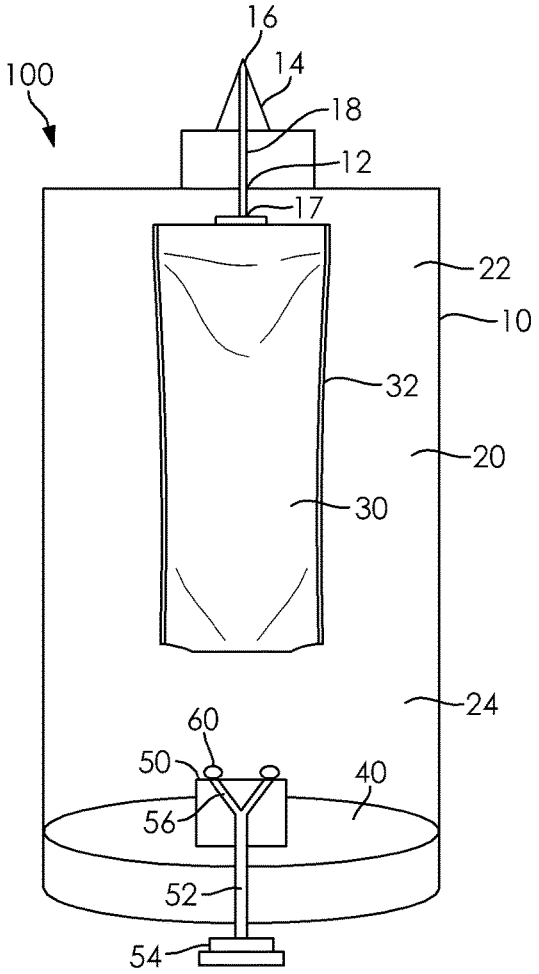
FIG. 3B is a schematic cross-sectional view of the dispenser of FIG. 3A after dispensing the material.

According to some inventive embodiments, the inventive dispenser 100 additionally includes a reservoir activation pin 52, as shown in FIGS. 1A-3B, 7A, and 7B. The reservoir activation pin 52 includes a first end 54 that extends out of the canister 10 and a second end 56 positioned within the second portion 24 of the chamber 20 adjacent to the enclosed reservoir 50. The activation pin 52 is configured to open the enclosed reservoir 50. According to some inventive embodiments, the activation pin 52 opens the reservoir 50 with the second end 56 of the activation pin 52 being configured to puncture the enclosed reservoir 50 upon actuation of the first end 54 of the activation pin 52 by a user of the inventive dispenser 100, as in FIGS. 2A and 2B. According to some inventive embodiments, the activation pin 52 opens the reservoir 50 with the second end 56 of the activation pin 52 being mechanically coupled to the enclosed reservoir 50 and configured to reversibly open the enclosed reservoir 50 upon actuation of the first end 54 of the activation pin 52, as in FIGS. 1A and 1B. According to some inventive embodiments, the activation pin 52 is actuated by a user directly interacting with the first end 54 of the activation pin 52, as with the embodiment shown in FIGS. 3A, 3B, 7A, and 7B. According to such embodiments, a user presses the first end 54 of the activation pin 52, thereby causing the second end 56 of the activation pin 52 to come into contact with the enclosed reservoir 50. According to some inventive embodiments, the enclosed reservoir 50 is opened by the activation pin 52 when a user hits the first end 54 of the activation pin 52 into a surface external to the dispenser 100 with force sufficient to cause the second end 56 of the activation pin 52 to puncture or otherwise break the enclosed reservoir 50. According to some inventive embodiments, the second end 56 of the activation pin 52 is mechanically coupled to an actuator 16 positioned around the opening 12 at the exterior of the canister 10, as shown in FIGS. 1A and 1B. According to such embodiments, depression of the actuator 16 by a user moves the activation pin 52 within the chamber 20 of the canister 10. The movement of the activation pin 52, which is coupled at its first end 54 to the enclosed reservoir 50, causes the first end 54 of the activation pin 52 to reversibly open the enclosed reservoir 50, for example by reversibly removing a seal that otherwise covers an opening in the enclosed reservoir 50 when the activation pin 50 is not actuated.

The solution 40 and the catalyst 60 are selected such that upon combination a composition compatible gas is evolved. Evolved gases include hydrogen, oxygen, carbon dioxide, or nitrogen. Solution 40-catalyst 60 combinations operative herein include: acid-iron, acid-copper, acid-platinum, acid-hydrogen peroxide-acid, hydrogen peroxide-silver metal or compounds, hydrogen peroxide-platinum metal or compounds, hydrogen peroxide-iron (III) chloride, hydrogen peroxide-catalase, acid-inorganic carbonate, acid-inorganic bicarbonate, or sugar-yeast. It is appreciated that an approximate stoichiometric ratio or excess of gas evolving constituent relative to the reactant therewith is present. According to some inventive embodiments, the solution 40 additionally includes a surfactant. It should be appreciated the strength of the acid in terms of pH required to evolve gases is well known for a given reactant. As noted above, the solution 40 is allowed to come into contact with the catalyst solution 60 inside a closed canister 10 facilitates gas evolution to create pressure within the canister 10. The pressure continues rising until sufficient force is generated to eject the material 30 (for example, a hair spray or a Fix-a-Flat™ tire sealant) out of the canister 10 through the opening 12. It will be understood that the catalyst 40 can be provided in the second portion 26 of the chamber 20 and the solution 40 can be provided in the enclosed reservoir 50, according to some inventive embodiments of the present invention. Advantageously, with of the canister designs disclosed herein, the present invention enables a steady pressure to dispense product and avoid use of aerosol propellants, which is a significant improvement over existing aerosol dispensers that utilize harmful propellants and those that use a one-time charge of pressurized air or carbon dioxide, which have a steep pressure drop-off.

It will be understood that according to embodiments where the enclosed reservoir 50 is irreversibly opened, for example by puncture, rupture, or breaking, the inventive dispenser 100 is a one-time use dispenser. However, embodiments of the inventive dispenser 100 alternatively provide a multi-use dispenser 100, where the catalyst 60 is controllably metered from the enclosed reservoir 50 by opening the reservoir 50 in a reversible manner, as described above.

According to some inventive embodiments, the inventive dispenser 100 is provided with a 16 ounce canister 10. The pressure within the canister is 9 psi, the volume is 41 L, and the temperature is 293 K. The theoretical mol of oxygen is 1.04 mol. Additionally, the mol of $H_2O_2$ is 4.17 mol, with potassium iodine present at 405.9 g the can is fully pressurized.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention but is not meant to be a limitation upon the practice thereof. The following claims, including all equivalents thereof, are intended to define the scope of the invention.

The invention claimed is:

1. A dispenser for dispensing material under pressure, the dispenser comprising:

a canister defining a chamber and having an opening therein extending from the chamber to an exterior of the canister;

a first portion of the chamber adjacent the opening configured to contain a material for dispensing through the opening;

a second portion of the chamber configured to contain a solution;

an actuator, wherein the actuator is positioned around the opening at the exterior of the canister opening in the chamber extending to the exterior of the canister is extended through the actuator; and an enclosed reservoir provided in the second portion of the chamber, the enclosed reservoir configured to initially contain a catalyst and to be subsequently opened to release at least a portion of the catalyst;

a reservoir activation pin, wherein the reservoir activation pin has a first end that extends out of the canister through the actuator in a first opening and a second end positioned within the second portion of the chamber adjacent to the enclosed reservoir, the activation pin configured to open the enclosed reservoir; and a tube, wherein the tube is positioned within the opening through which the material is configured to be dispensed, a first end of the tube extending into the first portion of the chamber and a second end of the tube extending out of the canister at a second opening.

2. The dispenser of claim 1 further comprising a nozzle positioned around the opening at the exterior of the canister through which the material is configured to be dispensed.

3. The dispenser of claim 1 wherein the second end of the tube is configured to be connected to a hose.

4. The dispenser of claim 1 wherein the second end of the tube is configured to fluidly communicate with an opening in an actuator when the actuator is depressed.

5. The dispenser of claim 1 wherein the first portion of the chamber and the second portion of the chamber are separated by a piston disposed within the canister.

6. The dispenser of claim 5 wherein the piston includes a punch-out disk in axial alignment with the opening in the canister.

7. The dispenser of claim 1 wherein the first portion of the chamber contains a flexible bag that contains the material for dispensing, the flexible bag being in fluid communication with the opening of the canister.

8. The dispenser of claim 7 wherein the flexible bag is formed of low-density polyethylene.

9. The dispenser of claim 1 wherein the enclosed reservoir is formed of high-density polyethylene or glass.

10. The dispenser of claim 1 wherein the second end of the activation pin is mechanically coupled to the enclosed reservoir and configured to reversibly open the enclosed reservoir upon actuation of the first end of the activation pin.

11. The dispenser of claim 10 wherein the second end of the activation pin is configured to puncture the enclosed reservoir upon actuation of the first end of the activation pin.

12. The dispenser of claim 1 wherein the enclosed reservoir is configured to be broken upon squeezing the canister.

13. The dispenser of claim 1 wherein the enclosed reservoir is configured to be broken upon bending the canister.

14. The dispenser of claim 1 wherein when the catalyst is released from the enclosed reservoir and mixes with the solution in the second portion of the chamber, a gas is formed that increases the pressure within the canister, thereby pushing the material to be dispensed out of the first portion of the chamber through the opening in the canister.

15. The dispenser of claim 1 wherein the dispenser is free of a propellant.

16. A dispenser for dispensing material under pressure, the dispenser comprising:

a canister defining a chamber and having an opening therein extending from the chamber to an exterior of the canister;

a first portion of the chamber adjacent the opening configured to contain a material for dispensing through the opening;

a second portion of the chamber configured to contain a solution;

an actuator, wherein the actuator is positioned around the opening at the exterior of the canister opening in the chamber extending to the exterior of the canister is extended through the actuator;

an enclosed reservoir provided in the second portion of the chamber, the enclosed reservoir configured to initially contain a catalyst and to be subsequently opened to release at least a portion of the catalyst; and a reservoir activation pin, wherein the reservoir activation pin has a first end that extends out of the canister through the actuator in a first opening and a second end positioned within the second portion of the chamber adjacent to the enclosed reservoir, the activation pin configured to reversibly open the enclosed reservoir in an actuated state and reversibly close the enclosed reservoir in a deactuated state, wherein when the enclosed reservoir is in the actuated state, a material is configured to release out of the first opening.

17. A dispenser for dispensing material under pressure, the dispenser comprising:

a canister defining a chamber and having an opening therein extending from the chamber to an exterior of the canister;

a first portion of the chamber adjacent the opening configured to contain a material for dispensing through the opening;

a second portion of the chamber configured to contain a solution; and an enclosed reservoir provided in the second portion of the chamber, the enclosed reservoir configured to initially contain a catalyst and to be subsequently opened to release at least a portion of the catalyst, wherein the enclosed reservoir is configured to be broken upon shaking the canister, wherein the shaking the canister mixes all of the catalyst and the solution at once for dispensing.

* * * * *